US012788173B2

(12) United States Patent
Wu

(10) Patent No.: US 12,788,173 B2
(45) Date of Patent: Nov. 10, 2026

(54) ARCUATE SHOWER CURTAIN ROD

(71) Applicant: Libing Wu, Zhoukou (CN)

(72) Inventor: Libing Wu, Zhoukou (CN)

( * ) Notice: Subject to any disclaimer, the term of this patent is extended or adjusted under 35 U.S.C. 154(b) by 148 days.

(21) Appl. No.: 18/934,544

(22) Filed: Nov. 1, 2024

(65) Prior Publication Data

US 2026/0108092 A1 Apr. 23, 2026

(30) Foreign Application Priority Data

Oct. 23, 2024 (CN) ..... 202422568157.6

(51) Int. Cl.
*A47H 1/022* (2006.01)
*A47H 1/02* (2006.01)

(52) U.S. Cl.
CPC ..... *A47H 1/022* (2013.01); *A47H 2001/0205* (2013.01); *A47H 2001/0215* (2013.01)

(58) Field of Classification Search
CPC .. A47K 3/38; A47H 1/022; A47H 2001/0205; A47H 2001/0215
See application file for complete search history.

(56) References Cited

U.S. PATENT DOCUMENTS 9,204,764 B1 * 12/2015 Hanley ..... A47K 3/38
10,959,559 B2 * 3/2021 Moss ..... A47H 1/022
11,937,725 B2 * 3/2024 Xu ..... A47H 1/142
12,102,252 B2 * 10/2024 Liu ..... A47H 1/022
2014/0131298 A1 * 5/2014 Didehvar ..... A47H 1/022 211/105.2

FOREIGN PATENT DOCUMENTS

CN 205349948 U 6/2016
CN 211582552 U 9/2020
CN 213664737 U 7/2021

* cited by examiner

*Primary Examiner* — Janie M Loeppke
(74) *Attorney, Agent, or Firm* — Sang Young Han

(57) ABSTRACT

The present invention provides a novel arcuate shower curtain rod. According to the present invention, a plurality of arcuate rod bodies are connected in sequence to form a complete arcuate shower curtain rod, where two adjacent rod bodies are detachably and fixedly connected through a connecting member, the connecting member includes a male plug and a female plug, the male plug and the female plug are connected to the two adjacent rod bodies respectively, then the two adjacent rod bodies are detachably and fixedly connected through mutual insertion between the male plug and the female plug, and finally, two ends of the arcuate shower curtain rod are fixed to corresponding to-be-mounted positions respectively to complete assembly. An overall structure is simple, and mounting is convenient. The arcuate shower curtain rod is split into the plurality of rod bodies through detachable matching between the male plug and the female plug.

8 Claims, 4 Drawing Sheets

ARCUATE SHOWER CURTAIN ROD

CROSS-REFERENCE TO RELATED APPLICATIONS

The application claims priority to Chinese patent application No. 202422568157.6, filed on Oct. 23, 2024, the entire contents of which are incorporated herein by reference.

TECHNICAL FIELD

The present invention relates to the technical field of shower curtain rods, and in particular, to a novel arcuate shower curtain rod.

BACKGROUND

At present, in an indoor shower room of a home, a hotel, and the like, a shower curtain is usually hung to partition the shower room to prevent water from splashing to make the shower room floor too wet and inconvenient to walk during a shower. The shower curtain is mainly supported by a shower curtain rod when being hung, that is, the shower curtain rod is mounted on a wall to hang the shower curtain.

A traditional shower curtain rod is usually of an integrally-formed structure such as a straight line-shaped structure, an L-shaped structure, or an arcuate structure. Although the integrally-formed shower curtain rod is relatively aesthetic overall, the shower curtain rod cannot be disassembled and assembled, resulting in large occupation space and inconvenient transportation. In addition, due to the different sizes of shower rooms, the universality is low.

SUMMARY

A main purpose of the present invention is to provide a novel arcuate shower curtain rod, aiming to solve problems of large occupation space, difficult transportation, and low universality caused by an existing arcuate shower curtain rod that is integrally formed.

To implement the above problems, the present invention provides a novel arcuate shower curtain rod, including a connecting member and a plurality of arcuate rod bodies, where the connecting member includes a male plug and a female plug that are inserted into and matched with each other, and two adjacent rod bodies are connected to the male plug and the female plug respectively, so that the two adjacent rod bodies are detachably and fixedly connected through mutual insertion between the male plug and the female plug.

According to the technical solutions of the present invention, a plurality of arcuate rod bodies are connected in sequence to form a complete arcuate shower curtain rod, where two adjacent rod bodies are detachably and fixedly connected through a connecting member, the connecting member includes a male plug and a female plug, the male plug and the female plug are connected to the two adjacent rod bodies respectively, then the two adjacent rod bodies are detachably and fixedly connected through mutual insertion between the male plug and the female plug, and finally, two ends of the arcuate shower curtain rod are fixed to corresponding to-be-mounted positions respectively to complete assembly. An overall structure is simple, and mounting is convenient. The arcuate shower curtain rod is split into the plurality of rod bodies through detachable matching between the male plug and the female plug, to implement splitting and accommodation, which effectively reduces occupation space and improves transportation convenience. In addition, according to different sizes of shower rooms, the arcuate shower curtain rod may be expanded or shrunk by increasing or reducing a quantity of rod bodies, thereby presenting good universality of the arcuate shower curtain rod.

DETAILED DESCRIPTION OF THE EMBODIMENTS

The following clearly and completely describes the technical solutions in the embodiments of the present invention with reference to the accompanying drawings. Apparently, the described embodiments are only some rather than all of the embodiments of the present invention. All other embodiments obtained by those of ordinary skill in the art based on the embodiments of the present invention without creative efforts shall fall within the protection scope of the present invention.

It should be noted that if directional indications (such as above, under, left, right, front, rear, top, bottom, inner, outer, vertical, horizontal, longitudinal, anticlockwise, clockwise, circumferential, radial, axial, . . . ) are involved in the embodiments of the present invention, the directional indications are only intended for explaining a relative position relationship, a motion condition, and the like, between components in a certain posture (as shown in the accompanying drawings), and if the posture changes, the directional indications change accordingly.

In addition, if the descriptions of "first", "second", or the like are involved in the embodiments of the present invention, the descriptions of "first", "second", or the like are for descriptive purposes only, and cannot be understood to indicate or imply relative importance or implicitly indicate the quantity of indicated technical features. Therefore, defining features with "first" and "second" can explicitly or implicitly indicate that at least one of such features is included. In addition, the technical solutions of various embodiments may be combined with each other, but must be based on implementation of a person of ordinary skill in the art, and when the combination of the technical solutions is contradictory or cannot be implemented, it should be considered that the combination of the technical solutions does not exist, and is not within the protection scope of the present invention.

The present invention provides a novel arcuate shower curtain rod.

In embodiments of the present invention, as shown in FIG. 1 to FIG. 4, the novel arcuate shower curtain rod includes a connecting member and a plurality of arcuate rod bodies 1, the connecting member includes a male plug 2 and a female plug 3 that are inserted into and matched with each other, and two adjacent rod bodies 1 are connected to the male plug 2 and the female plug 3 respectively, so that the two adjacent rod bodies 1 are detachably and fixedly connected through mutual insertion between the male plug 2 and the female plug 3.

Figure 1:
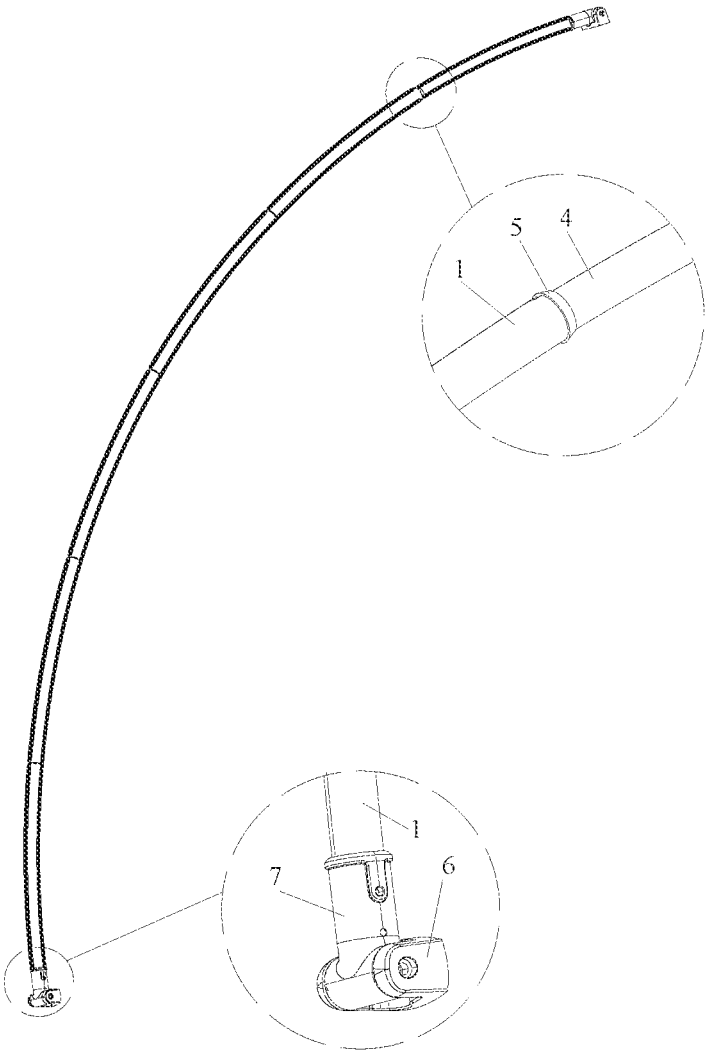
FIG. 1 is a schematic diagram of the present invention.
Figure 2:
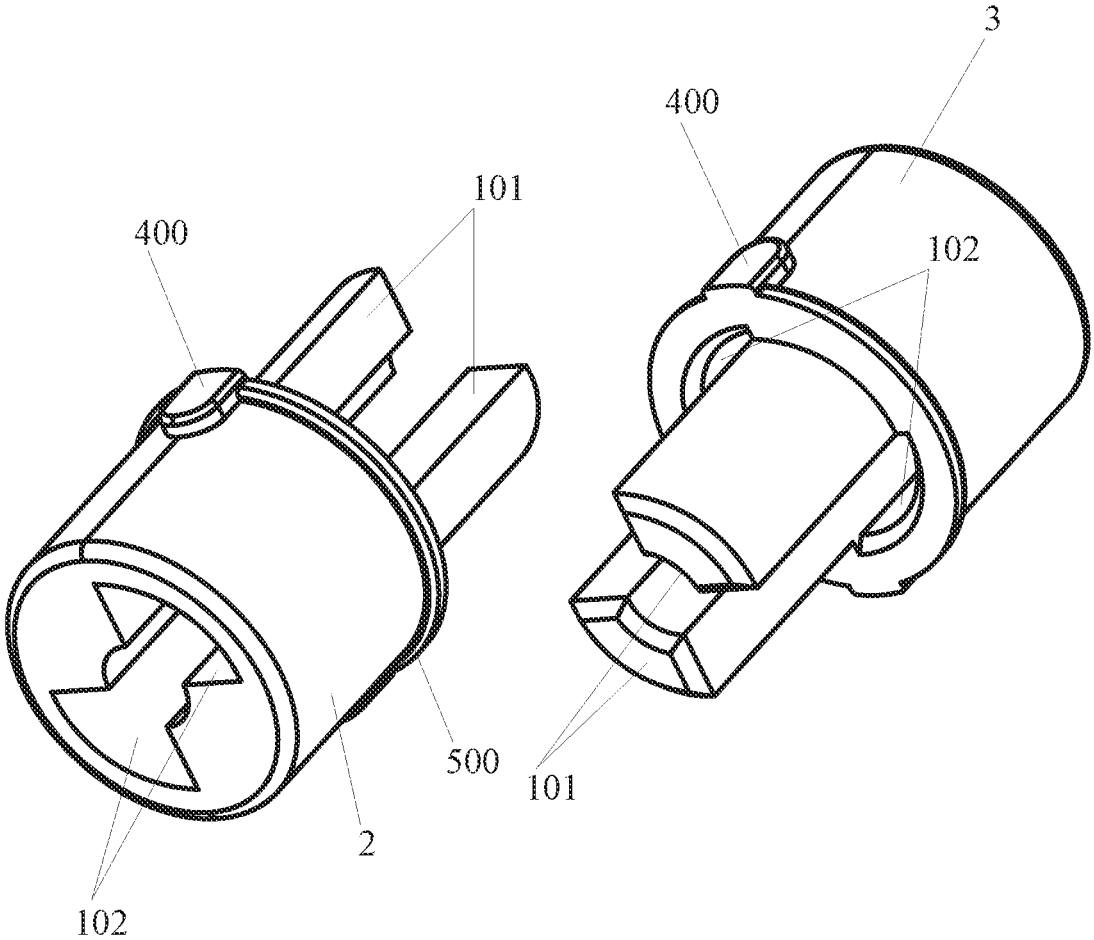
FIG. 2 is a schematic diagram of a first embodiment of a connecting member.

Specifically, in a first embodiment, as shown in FIG. 2, the male plug 2 is provided, at intervals, with a pair of long strip-shaped elastic portions 101, the female plug 3 is provided with inserting grooves 102 matched with the elastic portions 101, the male plug 2 is inserted into and matched with the female plug 3 through insertion and matching between the elastic portions 101 and the inserting grooves 102, and outer walls of the elastic portions 101 elastically abut against groove walls of the inserting grooves 102.

Further, in an embodiment, the elastic portions 101 and the inserting grooves 102 are disposed on the male plug 2, and a structure of the female plug 3 is the same as a structure of the male plug 2. During assembly, the elastic portions 101 located at the male plug 2 are inserted into the inserting grooves 102 of the female plug 3, and elastic portions 101 located at the female plug 3 are inserted into inserting grooves 102 of the male plug 2.

Figure 3:
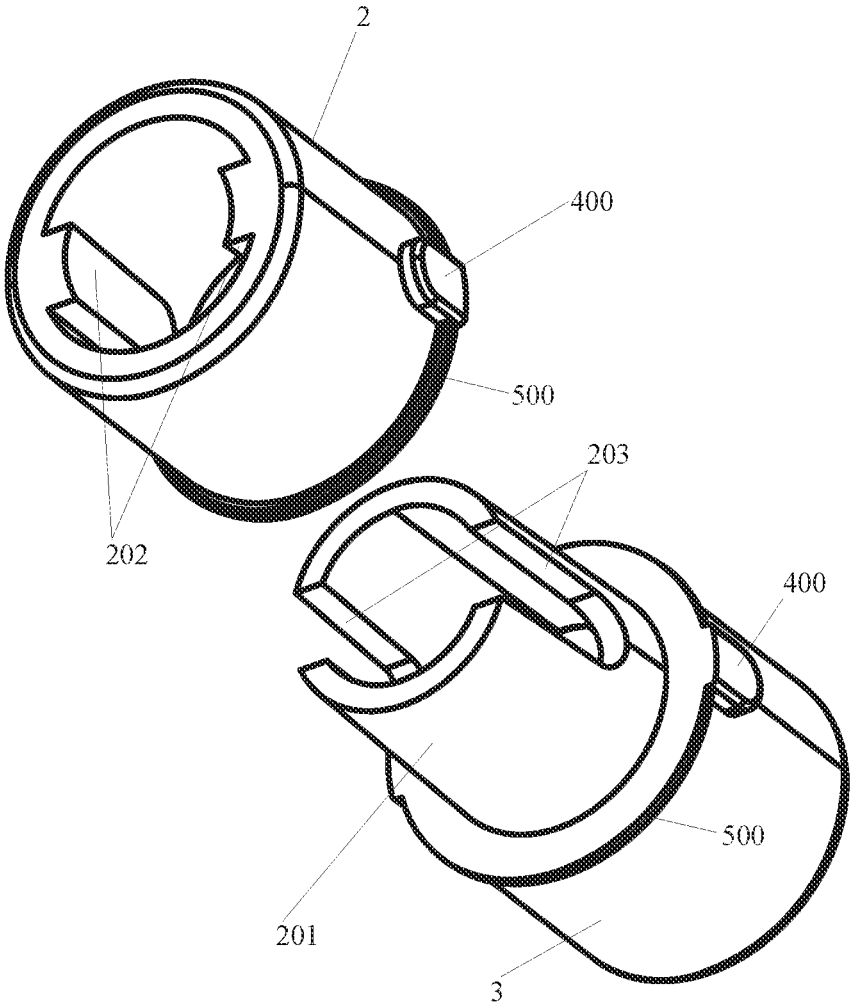
FIG. 3 is a schematic diagram of a second embodiment of a connecting member.

In a second embodiment, as shown in FIG. 3, the female plug 3 is provided with a columnar member 201, the male plug 2 is a connecting sleeve that may be sleeved on the columnar member 201, an inner wall of the connecting sleeve is provided with a protruding limiting portion 202, the columnar member 201 is provided with a limiting groove 203 that may allow the limiting portion 202 to be clamped, and the limiting portion 202 is located in the limiting groove 203 after the male plug 2 is sleeved on the columnar member 201.

Specifically, a diameter of one end, close to the female plug 3, of the columnar member 201 is larger, and a diameter of the other end thereof is smaller. In addition, after the male plug 2 is assembled with the female plug 3, an outer wall of the columnar member 201 elastically abuts against an inner wall of the male plug 2. Specifically, the columnar member 201 is of a hollow structure.

Figure 4:
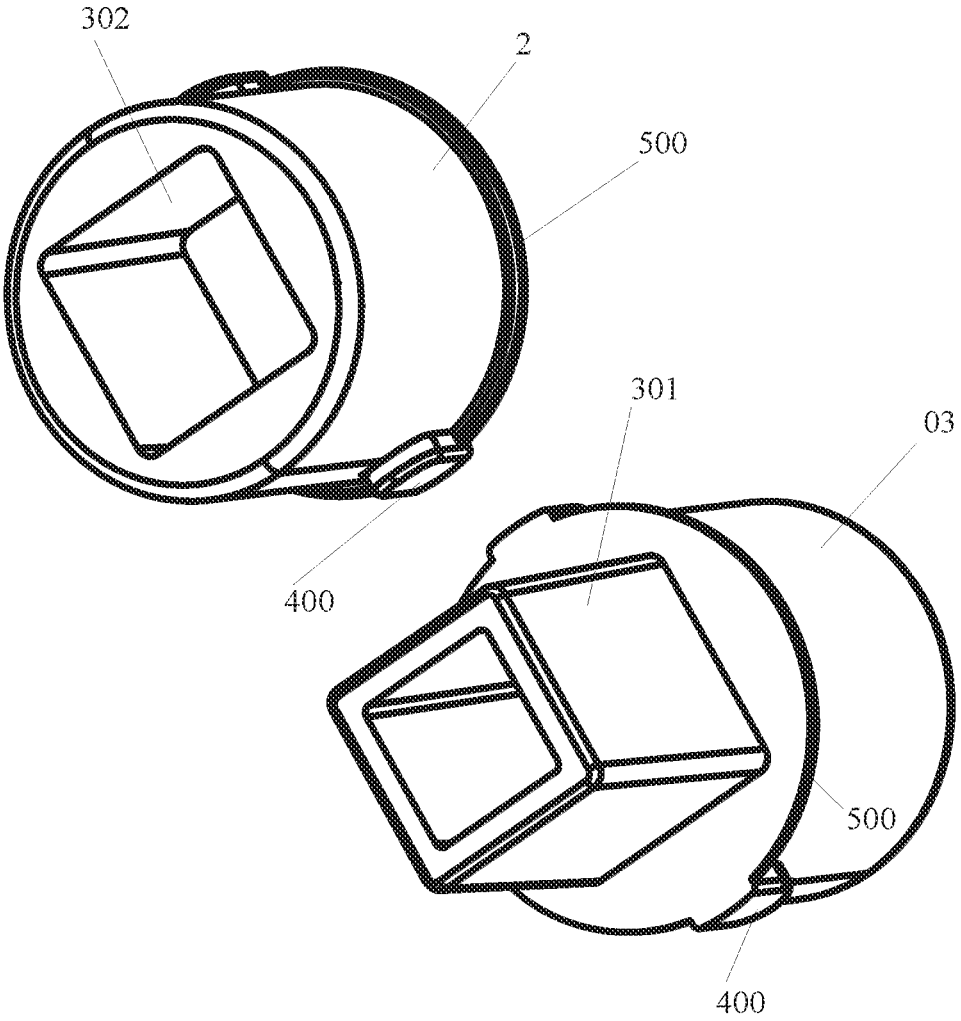
FIG. 4 is a schematic diagram of a third embodiment of a connecting member.

In a third embodiment, as shown in FIG. 4, the female plug 3 is provided with a non-circular connecting plug 301, the male plug 2 is provided with an inserting position 302 adapted to the connecting plug 301, the male plug 2 is connected to the female plug 3 through inserting and matching between the connecting plug 301 and the inserting position 302, and an outer wall of the connecting plug 301 elastically abuts against the inserting position 302.

Specifically, the male plug 2 and the female plug 3 are plastic products, metal products, or acrylic products.

Specifically, the connecting member is a plastic product, a metal product, or an acrylic product.

A telescopic rod 4 is movably connected to the rod body 1 correspondingly located at an end portion of one end or end portions of two ends of the arcuate shower curtain rod, and the telescopic rod 4 may move, relative to the rod body 1, between positions at which one end, away from the rod body 1, of the telescopic rod 4 is close and away from the rod body 1.

Specifically, the rod body 1 is a hollow tubular member, and the telescopic rod 4 is movably inserted into the rod body 1; or the telescopic rod 4 is a hollow tubular member, and the telescopic rod 4 is movably sleeved on the rod body 1.

Specifically, a clamping sleeve 5 that may be sleeved on the telescopic rod 4 is further included. The clamping sleeve 5 is clamped at an end portion of the rod body 1, and an inner wall of the clamping sleeve 5 is in elastic contact with an outer wall of the telescopic rod 4, to prevent a surface of the telescopic rod 4 from being scratched.

Specifically, the clamping sleeve 5 is made of rubber or silicone rubber preferentially.

Specifically, each of the male plug 2 and the female plug 3 is inserted into and fixed to the end portion of the rod body 1, and each of the male plug 2 and the female plug 3 is provided with a limiting flange 500 configured to abut against an end wall of the rod body 1, to prevent the male plug 2 and the female plug 3 from completely being inserted into the rod body 1; or each of the male plug 2 and the female plug 3 is provided with an inserting hole that may allow the end portion of the rod body 1 to be inserted; and an outer wall of each of the male plug 2 and the female plug 3 is provided with a protruding positioning portion 400, and the end portion of the rod body 1 is provided with a positioning groove that may allow the positioning portion 400 to be clamped.

Specifically, a connecting base 6 configured to be fixedly connected to a to-be-mounted position is further provided. The connecting base 6 is pivotally connected to a connecting portion 7, and the connecting portion 7 is configured to be connected to a free end of the shower curtain rod. The connecting portion 7 is of a hollow structure and may allow the free end of the shower curtain rod to be inserted.

According to the technical solutions of the present invention, a plurality of arcuate rod bodies are connected in sequence to form a complete arcuate shower curtain rod, where two adjacent rod bodies are detachably and fixedly connected through a connecting member, the connecting member includes a male plug and a female plug, the male plug and the female plug are connected to the two adjacent rod bodies respectively, then the two adjacent rod bodies are detachably and fixedly connected through mutual insertion between the male plug and the female plug, and finally, two ends of the arcuate shower curtain rod are fixed to corresponding to-be-mounted positions respectively to complete assembly. An overall structure is simple, and mounting is convenient. The arcuate shower curtain rod is split into the plurality of rod bodies through detachable matching between the male plug and the female plug, to implement splitting and accommodation, which effectively reduces occupation space and improves transportation convenience. In addition, according to different sizes of shower rooms, the arcuate shower curtain rod may be expanded or shrunk by increasing or reducing a quantity of rod bodies, thereby presenting good universality of the arcuate shower curtain rod.

The above descriptions are only preferential embodiments of the present invention, but are not intended to limit the patent scope of the present invention. Any equivalent structural variation made by using the specification and the accompanying drawings of the present invention, or directly/indirectly applied to other related technical fields under the invention concept of the present invention shall fall within the patent protection scope of the present invention.

What is claimed is:

1. A novel arcuate shower curtain rod, comprising a connecting member and a plurality of arcuate rod bodies (1), wherein the connecting member comprises a male plug (2) and a female plug (3) that are inserted into and matched with each other, and two adjacent rod bodies (1) are connected to the male plug (2) and the female plug (3) respectively, so that the two adjacent rod bodies (1) are detachably and fixedly connected through mutual insertion between the male plug (2) and the female plug (3);

a telescopic rod (4) is movably connected to the rod body (1) correspondingly located at an end portion of one end or end portions of two ends of the arcuate shower curtain rod, and the telescopic rod (4) can move, relative to the rod body (1), between positions at which one end, away from the rod body (1), of the telescopic rod (4) is close and away from the rod body (1);

a clamping sleeve (5) that can be sleeved on the telescopic rod (4), wherein the clamping sleeve (5) is clamped at an end portion of the rod body (1), and an inner wall of the clamping sleeve (5) is in elastic contact with an outer wall of the telescopic rod (4) to prevent a surface of the telescopic rod (4) from being scratched;

wherein the clamping sleeve (5) is made of rubber or silicone rubber.

2. The novel arcuate shower curtain rod according to claim 1, wherein the female plug (3) is provided with a columnar member (201), the male plug (2) is a connecting sleeve that can be sleeved on the columnar member (201), an inner wall of the connecting sleeve is provided with a protruding limiting portion (202), the columnar member (201) is provided with a limiting groove (203) that can allow the limiting portion (202) to be clamped, and the limiting portion (202) is located in the limiting groove (203) after the male plug (2) is sleeved on the columnar member (201).

3. The novel arcuate shower curtain rod according to claim 1, wherein the female plug (3) is provided with a non-circular connecting plug (301), the male plug (2) is provided with an inserting position (302) adapted to the connecting plug (301), the male plug (2) is connected to the female plug (3) through inserting and matching between the connecting plug (301) and the inserting position (302), and an outer wall of the connecting plug (301) elastically abuts against the inserting position (302).

4. The novel arcuate shower curtain rod according to claim 1, wherein the connecting member is a plastic product, a metal product, or an acrylic product.

5. The novel arcuate shower curtain rod according to claim 1, wherein the rod body (1) is a hollow tubular member, and the telescopic rod (4) is movably inserted into the rod body (1); or the telescopic rod (4) is a hollow tubular member, and the telescopic rod (4) is movably sleeved on the rod body (1).

6. The novel arcuate shower curtain rod according to claim 1, wherein an outer wall of each of the male plug (2) and the female plug (3) is provided with a protruding positioning portion (400), and an end portion of the rod body (1) is provided with a positioning groove that can allow the positioning portion (400) to be clamped.

7. The novel arcuate shower curtain rod according to claim 1, wherein a connecting base (6) configured to be fixedly connected to a to-be-mounted position is further provided, the connecting base (6) is pivotally connected to a connecting portion (7), and the connecting portion (7) is configured to be connected to a free end of the shower curtain rod.

8. A novel arcuate shower curtain rod, comprising a connecting member and a plurality of arcuate rod bodies (1), wherein the connecting member comprises a male plug (2) and a female plug (3) that are inserted into and matched with each other, and two adjacent rod bodies (1) are connected to the male plug (2) and the female plug (3) respectively, so that the two adjacent rod bodies (1) are detachably and fixedly connected through mutual insertion between the male plug (2) and the female plug (3);

the male plug (2) is provided, at intervals, with a pair of long strip-shaped elastic portions (101), the female plug (3) is provided with inserting grooves (102) matched with the elastic portions (101), the male plug (2) is inserted into and matched with the female plug (3) through insertion and matching between the elastic portions (101) and the inserting grooves (102), and outer walls of the elastic portions (101) elastically abut against groove walls of the inserting grooves (102).

* * * * *